US010105924B2

(12) United States Patent
Lee

(10) Patent No.: US 10,105,924 B2
(45) Date of Patent: Oct. 23, 2018

(54) BLANK FEEDING/PROCESSING APPARATUS

(71) Applicant: ACE MACHINERY CO., LTD., Siheung-si (KR)

(72) Inventor: Chul Lee, Goyang-si (KR)

(73) Assignee: ACE MACHINERY CO., LTD., Siheung-si (KR)

( * ) Notice: Subject to any disclaimer, the term of this patent is extended or adjusted under 35 U.S.C. 154(b) by 0 days.

(21) Appl. No.: 14/778,218

(22) PCT Filed: Mar. 5, 2015

(86) PCT No.: PCT/KR2015/002117
§ 371 (c)(1),
(2) Date: Sep. 18, 2015

(87) PCT Pub. No.: WO2016/140385
PCT Pub. Date: Sep. 9, 2016

(65) Prior Publication Data

US 2017/0361561 A1 Dec. 21, 2017

(51) Int. Cl.
*B31B 50/26* (2017.01)
*B31B 50/02* (2017.01)
*B31B 100/00* (2017.01)

(52) U.S. Cl.
CPC ..... *B31B 50/26* (2017.08); *B31B 50/02* (2017.08); *B31B 2100/002* (2017.08)

(58) Field of Classification Search
None
See application file for complete search history.

(56) References Cited

U.S. PATENT DOCUMENTS 1,803,935 A * 5/1931 Federwitz ..... B65B 43/52 198/576
3,094,320 A * 6/1963 Huck ..... B31B 70/00 226/41

(Continued)

FOREIGN PATENT DOCUMENTS

KR 1019977000580 2/1997
KR 100386535 6/2003

(Continued)

OTHER PUBLICATIONS

International Search Report—PCT/KR2015/002117 dated Oct. 29, 2015.

*Primary Examiner* — Hemant M Desai
*Assistant Examiner* — Tanzim Imam
(74) *Attorney, Agent, or Firm* — Cantor Colburn LLP

(57) ABSTRACT

Provided is a blank feeding/processing apparatus that includes a pressing unit for pressing a non-contact section of a conveyor belt to form an inclined section in the non-contact section when a box is folded. The apparatus for feeding and processing a blank having a plate shape, includes: a feeding unit including a lower feeding unit including a conveyor belt for conveying the blank and a plurality of feeding rollers for moving the conveyor belt, including a non-contact section that does not contact the feeding rollers in the conveyor belt, and arranged below the blank and an upper feeding unit arranged above the blank; and a pressing unit for protruding a tab of the blank to be processed, by applying a pressure in the non-contact section of the conveyor belt to form an inclined section in the conveyor belt.

6 Claims, 5 Drawing Sheets

(56) References Cited

U.S. PATENT DOCUMENTS

| | | | | | |
|---|---|---|---|---|---|
| 3,204,353 | A * | 9/1965 | Hajos | B65H 45/101 198/607 |
| 3,533,882 | A * | 10/1970 | Riese | B31C 3/00 156/189 |
| 4,018,144 | A * | 4/1977 | Stutt | B31B 50/00 493/408 |
| 5,151,075 | A * | 9/1992 | Beaulieu | B31B 50/00 271/144 |
| 5,413,327 | A * | 5/1995 | Reymond | B65H 9/163 271/251 |
| 5,423,733 | A * | 6/1995 | Adachi | D04H 1/74 493/411 |
| 2010/0236431 | A1* | 9/2010 | Roberts | B31F 1/07 101/23 |

FOREIGN PATENT DOCUMENTS

| | | | | |
|---|---|---|---|---|
| KR | 20040077844 | | 9/2004 | |
| KR | 200399376 | | 10/2005 | |
| KR | 100641643 | | 11/2006 | |
| KR | 101045213 | | 6/2011 | |
| KR | 20110067047 | | 6/2011 | |
| KR | 102011006704 | A * | 6/2011 | B31B 1/04 |
| KR | 101507904 | | 4/2015 | |

* cited by examiner

BLANK FEEDING/PROCESSING APPARATUS

TECHNICAL FIELD

The present invention relates to a blank feeding/processing apparatus, and more particularly to a blank feeding/processing apparatus for bending a blank formed of a low specific gravity material, for example, paper, a synthetic resin plate member, and a corrugated fiberboard to manufacture a box while automatically moving the blank.

BACKGROUND ART

In general, a box is prepared by cutting or pressing a tab that is to be folded in a sheet state, and is finished by folding the tab along a folding line and connecting ends thereof. Because the operation is repeatedly performed, the box is automatically manufactured by a machine.

A blank folding apparatus according to the related art includes a series of work stations, in particular, a feeder and an arrangement module for supplying blanks from a blank bundle one by one to a box manufacturing unit, a breaker that folds the blanks by about 90 to 180 degrees to preliminarily facture folding lines of the blanks, a folding module that folds tabs of the blanks by 180 degrees along the folding lines, and a press unit that compresses the folded blanks.

In particular, as illustrated in FIG. 1, the folding module includes two automatic folding mechanisms 12 and two upper guides 11, by which the blank 20 is moved to the left along the conveyor 1 and arranged above a movement surface of the blank 20.

In the folding module, a front tab is stopped by a lower end of a hook 13 of the automatic folding mechanism 12 as the blank 20 is moved to the left, and after the front tab 21 is pushed to a lower side of the upper guide 11 while the tab is successively moved to the left, the folding operation is completed.

However, in the blank folding module, an error of the folded tab not being stopped by the hook 13 or another part other than the folding line being bent may be caused.

PRIOR TECHNICAL DOCUMENTS

Patent Documents

Korean Patent Application Publication No. 10-1997-7000580

Korean Patent No. 10-0386535

DISCLOSURE

Technical Problem

The present invention has been made in an effort to solve the above-mentioned problems, and provides a blank feeding/processing apparatus that includes a pressing unit for pressing a non-contact section of a conveyor belt to form an inclined section in the non-contact section when a box is folded, increases utility, and reduces a malfunction and an error rate by automatically widening a tab of a blank due to a height difference of the conveyor belt when the box is folded.

Technical Solution

In accordance with an aspect of the present invention, there is provided an apparatus for feeding and processing a blank having a plate shape, the apparatus including: a feeding unit including a lower feeding unit including a conveyor belt for conveying the blank and a plurality of feeding rollers for moving the conveyor belt, including a non-contact section that does not contact the feeding rollers in the conveyor belt, and arranged below the blank and an upper feeding unit arranged above the blank; a pressing unit for protruding a tab of the blank that is to be processed, by applying a pressure in the non-contact section of the conveyor belt to form an inclined section in the conveyor belt; and a tension adjusting unit including a connection member, one end of which is rotatably mounted on the lower feeding unit, a first movement roller mounted on an opposite end of the connection member to move upwards and downwards, and connected to the conveyor belt of the lower feeding unit, and a first resiliency adjusting mechanism for resiliently supporting the first movement roller downwards with a compression coil spring, for adjusting a tension of the conveyor belt.

The apparatus may further include: a support unit arranged on an opposite side of the pressing unit with reference to the conveyor belt, for supporting the non-contact section of the conveyor belt, and the support unit is detachably mounted on the feeding unit to be separated when the pressing unit presses the non-contact section of the conveyor belt.

The pressing unit may include: a movable member arranged in the non-contact section to be moved upwards and downwards; a main roller mounted on the movable member; and an auxiliary roller arranged in the rearward movement direction of the blank of the main roller and mounted on the movable member.

The main roller may be arranged in the non-contact section of the conveyor belt, and the diameter of the main roller may be larger than that the vertical interval of the conveyor belt.

The pressing unit further may include: a displacement adjusting unit for adjusting a vertical movement degree of the movable member.

The tension adjusting unit may include: a second resiliency adjusting mechanism and a third resiliency adjusting mechanism arranged above the upper feeding unit to be spaced apart from each other; a second movement roller mounted between the second resiliency adjusting mechanism and the third resiliency adjusting mechanism to be moved upwards and downwards, and connected to the conveyor belt of the upper feeding unit; and a pair of fixing rollers arranged on opposite sides of the second movement roller, for pressing the conveyor belts arranged on opposite sides of the second movement roller downwards.

The upper feeding unit may include: a plurality of roller hangers formed to be inclined downward in the forward movement direction of the blank, and an end of which is resiliently rotatably mounted and an opposite end of which the feeding roller is mounted.

Advantageous Effects

The above-described blank feeding/processing apparatus according to the present invention has the following effects.

The upper feeding unit 300 is formed such that the roller hangers 320 are inclined downwards in the forward movement direction of the blank and are resiliently supported counterclockwise by a resilient body (not illustrated) so that the conveyor belt 340 may be prevented from being attached to the blank and slid when the blank is fed and the blank may be prevented from being separated from a location between the conveyor belt 220 and the conveyor belt 340.

Because the diameter of the main roller 520 is larger than the vertical interval of the conveyor belt 340, an upper end of the conveyor belt 340 is bent when the pressing unit 500 is raised, and the conveyor belt 340 can be prevented from being loosened when the non-contact section S is bent so that a constant tension can be maintained.

Because the blank feeding/processing apparatus according to the embodiment of the present invention forms a horizontal or inclined section in the non-contact section S if necessary by the pressing unit 500 that presses the conveyor belt, it can perform both a function of feeding the blank B and a function of folding the tab T of the blank B, increasing utility.

Furthermore, when the pressing unit 500 is lowered, the tab T of the blank B that passes through the non-contact section S is automatically widened by forming an inclined section in the non-contact section S so that it may be accurately stopped and folded by the stopper mechanism 600, and accordingly, a malfunction and an error rate thereof can be reduced.

In addition, because the displacement adjusting unit 540 for adjusting a vertical movement degree of the movable member 510 is provided in the pressing unit 500, the angle of the inclined section can be adjusted according to the material of the blank or an operation state so that precision can be increased during an operation thereof.

BEST MODE

Mode for Invention

Figure 1:
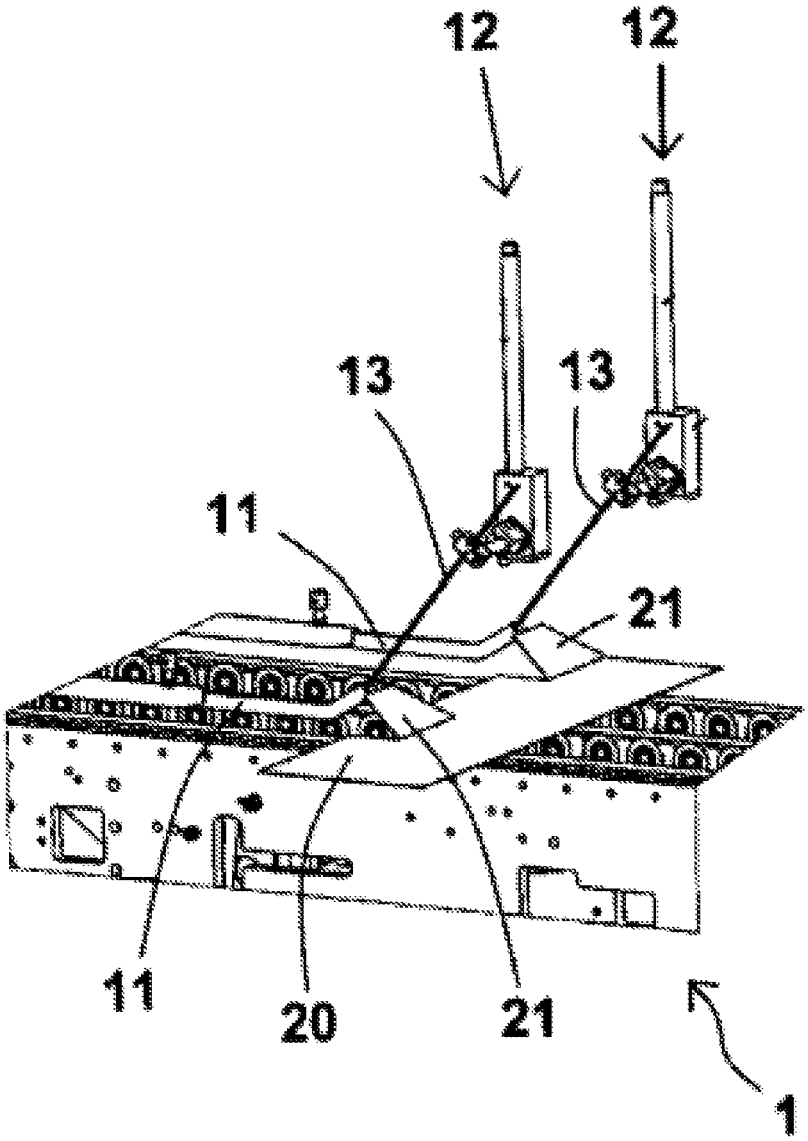
Fig. 1 Prior Art
FIG. 1 is a perspective view illustrating a blank feeding/processing apparatus according to the related art.
Figure 2:
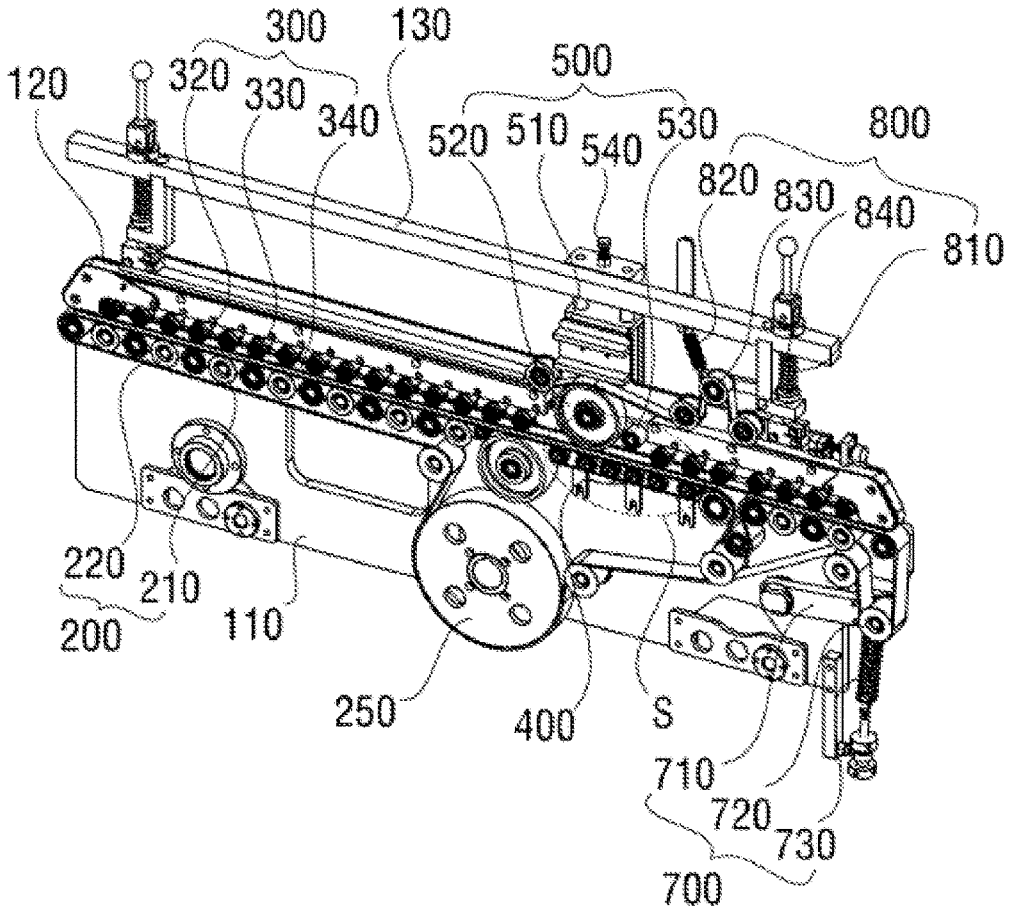
FIG. 2 is a perspective view illustrating a blank feeing/processing apparatus according to an embodiment of the present invention.
Figure 3:
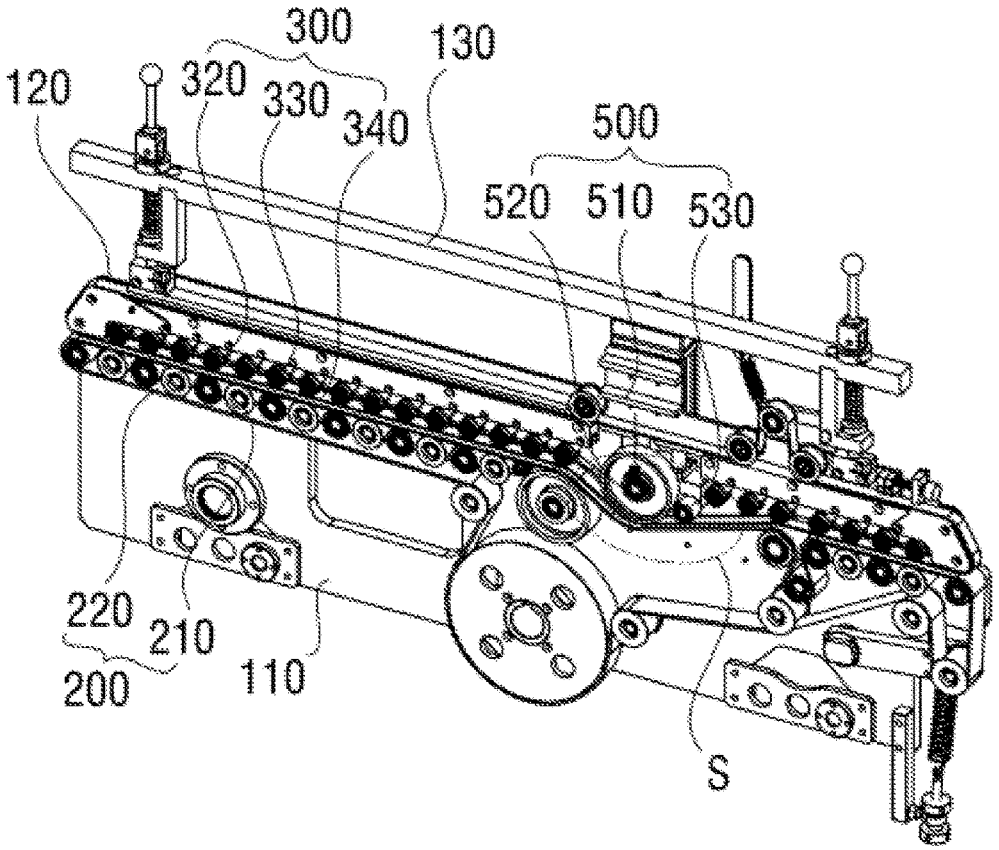
FIG. 3 is a perspective view illustrating a lowered state of a pressing unit of the blank feeing/processing apparatus according to the embodiment of the present invention.
Figure 4:
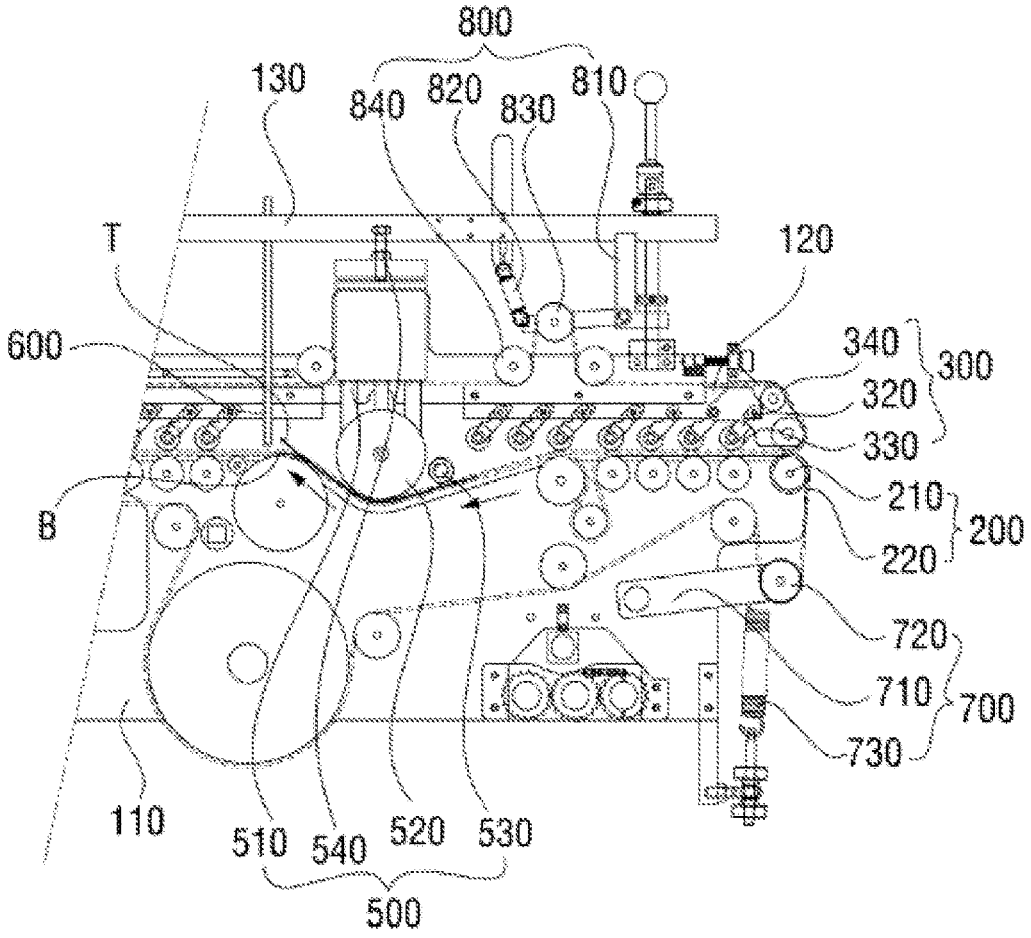
FIG. 4 is a view illustrating a state in which a tab part of a blank passes through a non-contact section using the blank feeding/processing apparatus according to the embodiment of the present invention.
Figure 5:
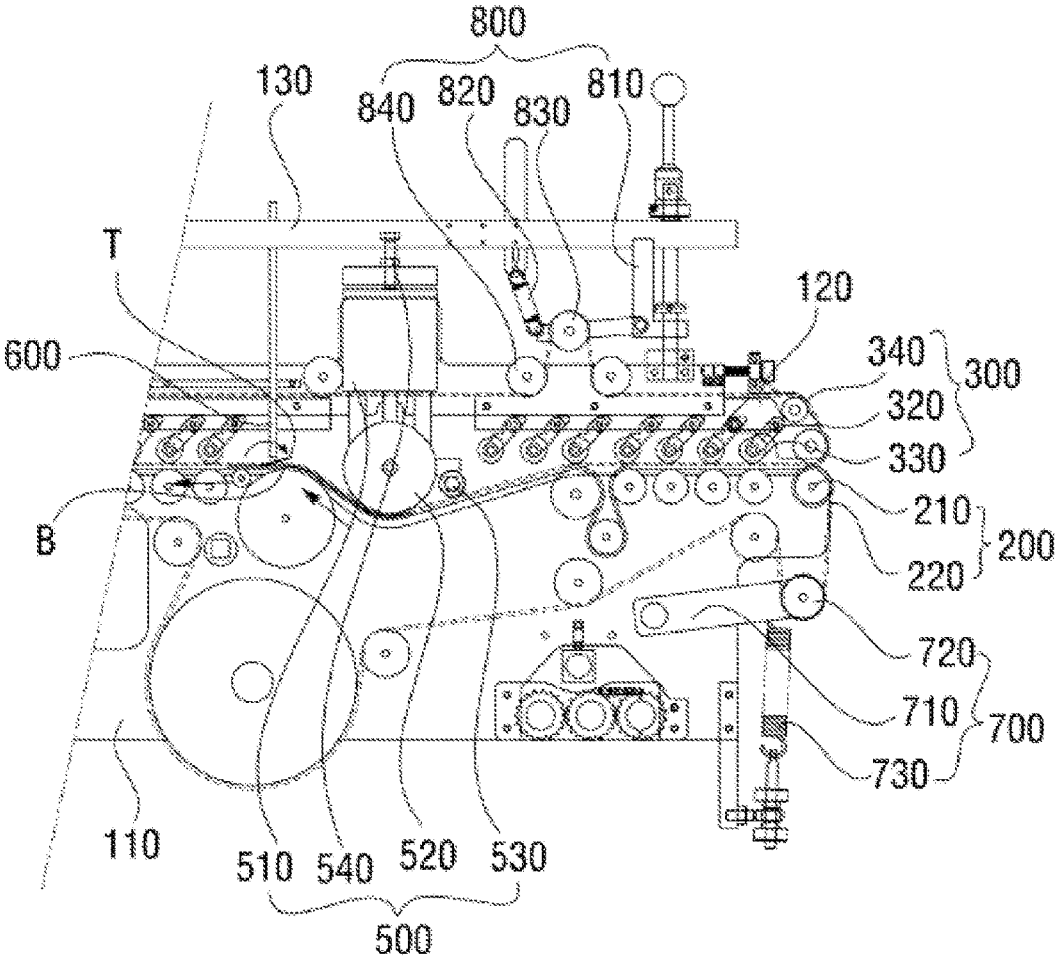
FIG. 5 is a view illustrating a state in which the tab part of the blank is folded while making contact with a stopper mechanism using the blank feeding/processing apparatus according to the embodiment of the present invention.

FIG. 2 is a perspective view illustrating a blank feeing/processing apparatus according to an embodiment of the present invention. FIG. 3 is a perspective view illustrating a lowered state of a pressing unit of the blank feeing/processing apparatus according to the embodiment of the present invention. FIG. 4 is a view illustrating a state in which a tab part of a blank passes through a non-contact section using the blank feeding/processing apparatus according to the embodiment of the present invention. FIG. 5 is a view illustrating a state in which the tab part of the blank is folded while making contact with a stopper mechanism using the blank feeding/processing apparatus according to the embodiment of the present invention.

As illustrated in FIGS. 2 to 5, the blank feeding/processing apparatus according to the embodiment of the present invention includes a feeding unit, a support unit 400, a pressing unit 500, a stopper mechanism 600, and a tension adjusting unit.

The blank is a plate element having a low specific gravity and is used to manufacture a box, and may be formed of various materials, for example, a corrugated fiberboard, a synthetic resin plate, and a film.

In detail, the feeding unit includes a lower frame 110, an upper frame 120, a hanger 130, a lower feeding unit 200, and an upper feeding unit 300.

The lower feeding unit 200 and the support unit 400 are mounted on the lower frame 110.

The upper frame 120 is installed above the lower frame 110 to be spaced apart from the lower frame 110, and the upper feeding unit 300 and the pressing unit 500 are mounted on the upper frame 120.

The hanger 130 is formed lengthily along a feeding direction of the blank, and is installed above the upper frame 120 to be spaced apart from the upper frame 120.

The hanger 130 is mounted on the stopper mechanism 600.

According to occasions, the lower frame 110, the upper frame 120, and the hanger 130 may be connected to each other, or may be integrally formed with each other.

The lower feeding unit 200 is a unit for moving the blank in one direction, and in detail, includes a plurality of feeding rollers 210 and a conveyor belt 220.

As illustrated in FIG. 2, the feeding rollers 210 are arranged along a forward movement direction of the blank to be spaced apart from each other by a predetermined interval, and are rotatably mounted on the lower frame 110.

The feeding rollers 210 are arranged to be spaced apart from by a distant interval in the non-contact section S which does not make contact the feeding rollers 210, in correspondence to the length of the support unit 400.

The feeding rollers 210 are rotated to move the conveyor belt 220 in the forward movement direction of the blank.

The conveyor belt 220 is an endless conveyor belt and is mounted to the feeding roller 210 to be rotated along a locus surrounding the feeding rollers 210 to move the blank. The conveyor belt 220 has a non-contact section S which does not make contact with the feeding rollers 210 and the support unit 400, which will be described below, is arranged below the non-contact section.

Here, the non-contact section S is formed to be horizontal in a movement direction of the blank when it is not pressed by the pressing unit 500, which will be described below, and an inclined section bent downwards is formed when the non-contact section S is not pressed by the pressing unit 500.

The lower feeding unit 200 receives a rotational force from a driving roller 250 rotated by an external power and thus is rotated.

The upper feeding unit 300 is arranged above the lower feeding unit 200, and in detail, includes roller hangers 320, feeding rollers 330, and a conveyor belt 340.

A plurality of roller hangers 320 corresponding to the feeding rollers 330, which will be described below, are provided and is formed to be inclined downwards in the forward movement direction of the blank, that is, to the left side. Upper ends of the roller hangers 320 are rotatably mounted on the upper frame 120, and the feeding rollers 330 are mounted on lower ends of the roller hangers 320.

The roller hangers 320 are resiliently supported counterclockwise by a resilient body (not illustrated), and move the feeding rollers 330 slightly upwards while rotating clockwise when the blank is moved forwards.

A plurality of feeding rollers 330 are provided, and are arranged in a row along the forward movement direction of the blank to be spaced apart from each other by a predetermined interval like the feeding rollers 210 and are rotatably mounted on lower ends of the roller hangers 320.

The feeding rollers 330 are arranged to be spaced apart from each other by a distant interval in correspondence of the width of the pressing unit 500 to form the non-contact section S in which the pressing unit 500, which will be described below, is arranged in the conveyor belt 220.

The feeding rollers 330 move the conveyor belt 220 in the forward movement direction of the blank.

The conveyor belt 340 is an endless conveyor belt like the conveyor belt 220, and is mounted on the feeding rollers 330 to be rotated along a locus surrounding the feeding rollers 330 to move the blank.

The conveyor belt 340 has the non-contact section S in which the pressing unit 500, which will be described below, is arranged while not making contact with the feeding rollers 230.

In this way, the upper feeding unit 300 is formed such that the roller hangers 320 are inclined downwards in the forward movement direction of the blank and are resiliently supported counterclockwise by a resilient body so that the conveyor belt 340 may be prevented from being attached to the blank B and slid when the blank is fed and the blank may be prevented from being separated from a location between the conveyor belt 220 and the conveyor belt 340.

The support unit 400 includes a frame and approximately five support rollers mounted on the frame, and the support rollers are arranged in a row to be parallel to the feeding roller 210.

Of course, the number of the support units 400 may be changed according to occasions.

The support unit 400 is arranged in the non-contact section S of the conveyor belt 200, and is detachably mounted on the lower frame 110 by a bolt.

When the pressing unit 500, which will be described below, is raised, the support unit 400 horizontally supports the non-contact section S of the conveyor belt 220 to smoothly feed the blank, and when the pressing unit 500 is lowered, the support unit 400 is separated from the lower frame 110.

The pressing unit 500 is arranged above the support unit 400, that is, in the non-contact section S of the conveyor belt 340, and is mounted on the upper frame 120 to be moved upwards and downwards and makes contact with the conveyor belt 340.

In detail, the pressing unit 500 includes a movable member 510, a main roller 520, an auxiliary roller 530, and a displacement adjusting unit 540.

The movable member 510 is mounted on the upper frame 120 and is raised and lowered by a hydraulic or pneumatic cylinder unit, and may be operated by various driving units such as a motor according to occasions.

The main roller is mounted on the movable member 510.

The main roller is rotatably mounted on the movable member 510 and makes contact with an inner peripheral surface of the conveyor belt 340. The diameter of the main roller 520 is larger than that of the feeding roller 330 and is larger than a vertical interval of the conveyor belt 340.

Accordingly, an upper end of the conveyor belt 340 is bent upwards by the main roller 520 when the support unit 400 is fixed to the lower frame 110 such that the non-contact sections S of the conveyor belt 220 and the conveyor belt 320 are horizontal, an upper end of the conveyor belt becomes horizontal and the non-contact section S is bent downwards by the main roller 520 when the support unit 400 is separated from the lower frame 110 and the pressing unit 500 is lowered.

Of course, the diameter of the main roller 520 may be smaller than the vertical interval of the conveyor belt 340, but because the vertical movement distance of the main roller 520 may be reduced and the bending depth of a lower end of the conveyor belt 340 when the main roller 520 is lowered may be the same as the bending depth of an upper end of the conveyor belt 340 before the main roller 520 is lowered without using a separate displacement mechanism, it is preferable that the diameter of the main roller 520 be larger than the vertical interval of the conveyor belt 340.

In this way, because the diameter of the main roller 520 is larger than the vertical interval of the conveyor belt 340, an upper end of the conveyor belt 340 is bent when the pressing unit 500 is raised, and the conveyor belt 340 can be prevented from being loosened when an inclined section is formed in the non-contact section S so that a constant tension can be maintained.

The auxiliary roller 530 is arranged on a rear side of the main roller 520 and is rotatably mounted on the movable member 510.

The auxiliary roller 530 is arranged below the center of rotation of the main roller 520, and the diameter of the auxiliary roller 530 is smaller than that of the main roller 520 so that the auxiliary roller 530 is arranged above a lower end of the main roller 520.

When the pressing unit 500 is lowered, the auxiliary roller 530 pushes the conveyor belt 340 to prevent the conveyor belt 340 from being loosened.

The displacement adjusting unit 540 is a unit for adjusting a vertical movement degree of the movable member 510, and is generally similar to the displacement adjusting unit of the cylinder unit and thus a detailed description thereof will be omitted.

In this way, because the displacement adjusting unit 540 for adjusting a vertical movement degree of the movable member 510 is provided in the pressing unit 500, the angle of the inclined section can be adjusted according to the material of the blank or an operation state so that precision can be increased during an operation thereof.

Meanwhile, as illustrated in FIGS. 4 and 5, the hanger 130 is provided with the stopper mechanism 600 for rotating and folding a tab T of the blank B when the blank B is moved.

The stopper mechanism 600 has a vertically long bar shape.

As illustrated in FIGS. 4 and 5, the stopper mechanism 600 makes contact with the tab T of the blank B that is moved forwards such that the tab T may be automatically folded clockwise.

Meanwhile, the tension adjusting unit includes a first tension adjusting unit 700 and a second tension adjusting unit 800.

Meanwhile, the first tension adjusting unit 700 constantly maintains the tension of the conveyor belt 220 with a resilient force when an inclined section is formed in the non-contact section S of the conveyor belt 220 as the pressing unit 500 is lowered.

In detail, the first tension adjusting unit 700 includes a connection member 710, a first movement roller 720, and a first resiliency adjusting mechanism 730.

The connection member 710 has a long bar shape, and one end of the connection member 710 is rotatably mounted on the lower frame and the first movement roller 720 is mounted on an opposite end of the connection member 710.

The first movement roller 720 is arranged inside the conveyor belt 220 to bend the conveyor belt 220 downwards, and is mounted on an opposite end of the connection member 710 to be moved upwards and downwards as the connection member 710 is rotated.

The first resiliency adjusting mechanism 730 is a unit for adjusting the tension of the first movement roller 720 by compressing and releasing the compression coil spring, and a lower end of the first resiliency adjusting mechanism is fixed to the lower frame 110 and an upper end thereof is mounted on the first movement roller 720 such that the first movement roller 720 is resiliently supported downwards.

Because the first tension adjusting unit 700 is configured such that the first movement roller 720 is resiliently supported by a resilient force of the first resiliency adjusting mechanism 730, the conveyor belt 220 is constantly maintained such that the conveyor belt 220 can be prevented from being loosened and the tension of the conveyor belt 220 can be adjusted according to occasions.

Meanwhile, the second tension adjusting unit 800 is mounted on the hanger 130, and is connected to the conveyor belt 340 to constantly maintain the tension of the conveyor belt 340.

In detail, as illustrated in FIGS. 2 to 5, the second tension adjusting unit 800 includes a second resiliency adjusting mechanism 810, a third resiliency adjusting mechanism 820, a second movement roller 830, and fixing rollers 840.

The second resiliency adjusting mechanism 810 is a unit for resiliently supporting the second movement roller 830, which will be described below, upwards by a compression coil spring, and one end of the second resiliency adjusting mechanism 810 is fixedly mounted on the hanger 130 and an opposite end thereof is connected to the second movement roller 830.

The second resiliency adjusting mechanism 810 is connected to the third resiliency adjusting mechanism 820.

The third resiliency adjusting mechanism 820 is arranged in front of the second resiliency adjusting mechanism to be spaced apart from the second resiliency adjusting mechanism and includes a compression coil spring, and one end of the third resiliency adjusting mechanism 120 is fixedly mounted on the hanger 130 and an opposite end thereof is connected to the second resiliency adjusting mechanism 810 on which the second movement roller 830 is mounted.

The third resiliency adjusting mechanism 820 is arranged to be inclined upwards from the second movement roller 830.

The second movement roller 830 makes contact with the conveyor belt 340 such that the conveyor belt 340 is bent upwards, and is moved upwards and downwards by the second resiliency adjusting mechanism 810 and the third resiliency adjusting mechanism 820.

The fixing rollers 840 are mounted on the upper frame 120, and are arranged on opposite sides of the second movement roller 830, respectively to press the conveyor belt 340 that passes by the second movement roller 830 downwards.

In this way, because the second tension adjusting unit 800 resiliently supports the second movement roller 830 with the second resiliency adjusting mechanism 810 and the third resiliency adjusting mechanism 820, it can adjust the conveyor belt 340 such that the conveyor belt 340 may not be loosened.

Meanwhile, as illustrated in FIG. 4, in the blank feeding/processing apparatus according to the embodiment of the present invention, the blank B having the tab T is arranged between the lower feeding unit 200 and the upper feeding unit 300 to be moved leftwards.

As illustrated in FIG. 2, when the blank feeding/processing unit is used simply as a feeding apparatus, the support unit 400 is mounted on the lower frame 110 such that the non-contact sections S of the conveyor belt 220 and the conveyor belt 340 are horizontal.

In contrast, as illustrated in FIG. 3, in order to fold the tab T of the blank B, the support unit 400 is separated from the lower frame 110 and the pressing unit 500 is lowered so that the non-contact sections S of the conveyor belt 220 and the conveyor belt 340 are bent concavely downwards to form an inclined section.

Thereafter, as illustrated in FIG. 4, if the blank B is moved leftwards, the tab T floats after being separated while the blank B passes through the inclined section of the non-contact section S.

Subsequently, as illustrated in FIG. 5, if the blank B is successively moved forwards to the left, the tab T makes contact with the stopper mechanism 600 to be rotated clockwise and bent.

In this way, because the blank feeding/processing apparatus according to the embodiment of the present invention forms a horizontal or inclined section in the non-contact section S if necessary by the pressing unit 500 that presses the conveyor belt, it can perform both a function of feeding the blank B and a function of folding the tab T of the blank B, increasing utility.

Furthermore, when the pressing unit 500 is lowered, the tab T of the blank B that passes through the non-contact section S is automatically widened by bending the non-contact section S downwards so that it may be accurately stopped and folded by the stopper mechanism 600, and accordingly, a malfunction and an error rate thereof can be reduced.

The present invention is not limited thereto, and may be modified in various forms by those skilled in the art without departing from the spirit of the present invention, and the modifications can be construed to fall within the scope of the present invention.

The invention claimed is:

1. An apparatus for feeding and processing a blank having a plate shape, the apparatus comprising:

a feeding unit comprising: a lower feeding unit comprising a conveyor belt for conveying the blank and a plurality of feeding rollers for moving the conveyor belt, the conveyor belt comprising a non-contact section that does not contact the feeding rollers, the lower feeding unit being arranged below the blank; and an upper feeding unit arranged above the blank;

a pressing unit for protruding a tab of the blank that is to be processed, by applying a pressure on the non-contact section of the conveyor belt to form an inclined section of the conveyor belt;

a tension adjusting unit comprising: a connection member, one end of which is rotatably mounted on a lower frame of the feeding unit; a first movement roller mounted on an opposite end of the connection member and being configured to move upwards and downwards, the first movement roller being connected to the conveyor belt of the lower feeding unit; and a first resiliency adjusting mechanism for resiliently supporting the first movement roller downwards with a compression coil spring, for adjusting a tension of the conveyor belt; and a support unit arranged on an opposite side of the pressing unit with reference to the conveyor belt, for supporting the non-contact section of the conveyor belt, wherein the support unit is detachably mounted on the feeding unit to be separated from the feeding unit when the pressing unit presses the non-contact section of the conveyor belt.

2. The apparatus of claim 1, wherein the pressing unit comprises:

a movable member arranged in a vicinity of the non-contact section and configured to be moved upwards and downwards;

a main roller mounted on the movable member; and an auxiliary roller arranged on a rear side of the main roller and mounted on the movable member.

3. The apparatus of claim 2, wherein the main roller is arranged in the vicinity of the non-contact section of the conveyor belt, and a diameter of the main roller is larger than a vertical interval of a conveyor belt of the upper feeding unit.

4. The apparatus of claim 2, wherein the pressing unit further comprises: a displacement adjusting unit for adjusting a vertical movement amount of the movable member.

5. The apparatus of claim 1, wherein the tension adjusting unit further comprises:

a second resiliency adjusting mechanism and a third resiliency adjusting mechanism arranged above the upper feeding unit and being spaced apart from each other;

a second movement roller mounted between the second resiliency adjusting mechanism and the third resiliency adjusting mechanism, the second movement roller being configured to be moved upwards and downwards, and the second movement roller being connected to a conveyor belt of the upper feeding unit; and a pair of fixing rollers arranged on opposite sides of the second movement roller, for pressing the conveyor belt of the upper feeding unit arranged on opposite sides of the second movement roller downwards.

6. The apparatus of claim 1, wherein the upper feeding unit comprises: a plurality of roller hangers formed to be inclined downward relative to a forward movement direction of the blank, wherein an end of each of the roller hangers is resiliently rotatably mounted, and a feeding roller of the upper feeding unit is mounted on an opposite end of each of the roller hangers.

* * * * *